US005376023A

United States Patent [19]

Matsuyama

[11] Patent Number: 5,376,023

[45] Date of Patent: Dec. 27, 1994

[54] ELECTRIC CONNECTOR

[75] Inventor: Yukio Matsuyama, Tokyo, Japan

[73] Assignee: NEC Corporation, Tokyo, Japan

[21] Appl. No.: 982,946

[22] Filed: Nov. 30, 1992

[30] Foreign Application Priority Data

Nov. 30, 1991 [JP] Japan ..... 3-106742[U]

[51] Int. Cl.[5] ..... H01R 13/432

[52] U.S. Cl. ..... 439/746; 439/750

[58] Field of Search ..... 439/744–746, 439/750, 747

[56] References Cited

U.S. PATENT DOCUMENTS 3,957,337 5/1976 Damiano .

FOREIGN PATENT DOCUMENTS 2320079 11/1974 Germany .

2029653 3/1980 United Kingdom ..... 439/747

2110889 6/1983 United Kingdom ..... 439/744

*Primary Examiner*—Eugene F. Desmond

*Attorney, Agent, or Firm*—Sughrue, Mion, Zinn, Macpeak & Seas

[57] ABSTRACT

An electric connector having a tubular portion 3 serving as expansion limiting means provided at the bottom of the inner spacing of outer housing 1 through which the male contact 4 extends for the purpose of limiting the expansion of lances 2 of the male contact 4. The inner diameter Di of the tubular portion 3 is equal to the sum of the outer diameter of the male contact 4 and the dimension of nearly 1.4 times the length L of the lances 2, and the expansion limiting angle $\theta$ of the lances 2 from the axis of the male contact 4 is nearly equal to 45°.

2 Claims, 5 Drawing Sheets

ELECTRIC CONNECTOR

BACKGROUND OF THE INVENTION

1. Field of the Invention

This invention relates to an electric connector for the connection of an electric circuit, and more particularly to improvements in or relating to the structure of a housing of an electric connector.

2. DESCRIPTION OF THE RELATED ART

Various electric connectors are already known, and a partial view of an example of a conventional electric connector is shown in FIG. 1. Referring to FIG. 1, the electric connector of the type shown is formed from a combination of an outer housing 1 having a male contact 4 and an inner housing 6 having a female contact 5. The inner housing 6 is fitted into the outer housing 1, whereby the male contact 4 in the outer housing 1 is force-fitted into the female contact 5 in the inner housing 6 to establish electric connection. Each contact 4, 5 of the male and female portions has a plurality of resilient lances 2, 7 extending laterally from the contacts, and after insertion of the male portion into the corresponding housing 1, 6, lances 2, 7 are expanded laterally in the internal spacing of each housing so as to prevent separation of the contacts 4, 5 from the housings 1, 6.

Dimension a in FIG. 1 is defined as a dimension necessary to maintain good contact between the male and female contacts 4 and 5 after the inner housing 6 is inserted into the outer housing 1, causing the male contact 4 to fit into the female contact 5.

Female contact may also be fixed within the inner housing by such means as soldering or by adhesive means rather than by lances.

However, when two housings 1 and 6 are coupled to each other, the contacts 4, 5 received pressure in the axial direction, and after coupling, each contact receives the tensile force of the electric wires connected to the contact. Repeated application of these external forces to the contacts 4, 5, may adversely affect the lances 2, 7 bringing about fatigue and may cause excessive expansion in radial directions as indicated by the broken lines in FIG. 2. If lances 2 are deformed in this manner, dimension a indicated in FIG. 1 is altered, and consequently, even if the two housings 1 and 6 are coupled to each other, complete contact cannot be established between contacts 4 and 5 and electric connection cannot be assured. This is a drawback of the conventional electric connector.

SUMMARY OF THE INVENTION

It is an object of the present invention to provide an electric connector which assures electric connection and eliminates the problem described above.

In order to attain the object, according to the present invention, an electric connector comprises expansion limiting means provided around a portion of each housing in which the lances of each contact extend for the purpose of limiting excessive expansion of the lances. The expansion limiting means is a tubular portion making up part of the housing, the inner diameter of the tubular portion being equal to the sum of the outer diameter of each contact and a dimension smaller than twice the length of the lances, preferably the dimension of 1.4 times the length of the lances.

The tubular portion may be formed integrally with the housing or may be manufactured as a tubular member separate from the housing and securely mounted, when the housing is assembled, into the portion of the housing through which the lances of the contact extend.

By the means described above, lateral expansion of the lances of the contact is limited to the inner diameter of the tubular portion, and preferably, the angular range of almost 45° with respect to the axial direction, and accordingly, the axial dimension necessary for the contact between the male and female contacts is assured and the reliability of the electric connection between the contacts is enhanced.

The above and other objects, features and advantages of the present invention will become apparent from the following description referring to the accompanying drawings which illustrate an example of a preferred embodiment of the present invention.

DETAILED DESCRIPTION OF THE PREFERRED EMBODIMENT

Figure 1:
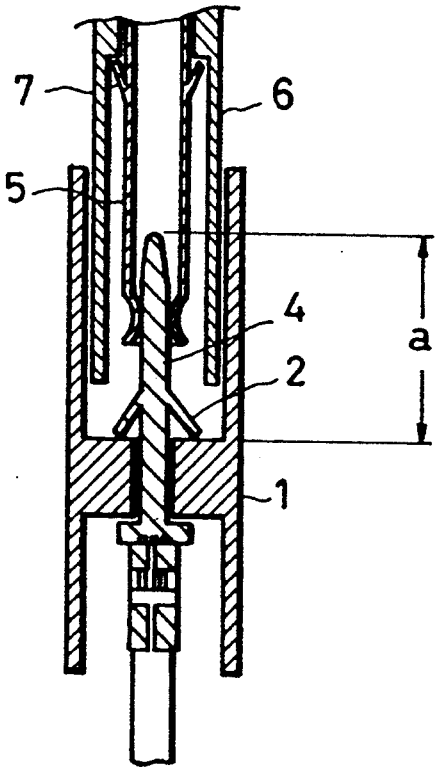
FIG. 1 a sectional view of a conventional electric connector.
Figure 2:
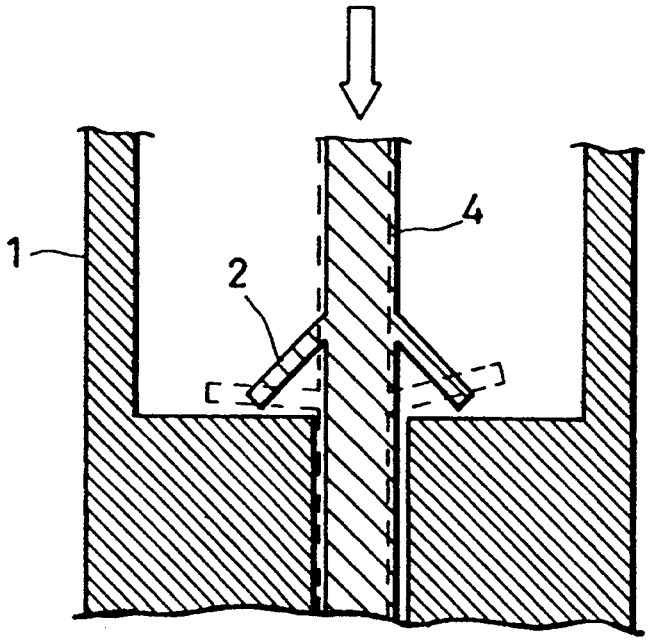
FIG. 2 is an enlarged sectional view illustrating setting or permanent set in fatigue of lances of a male connector of the conventional electric connector of FIG. 1.
Figure 3:
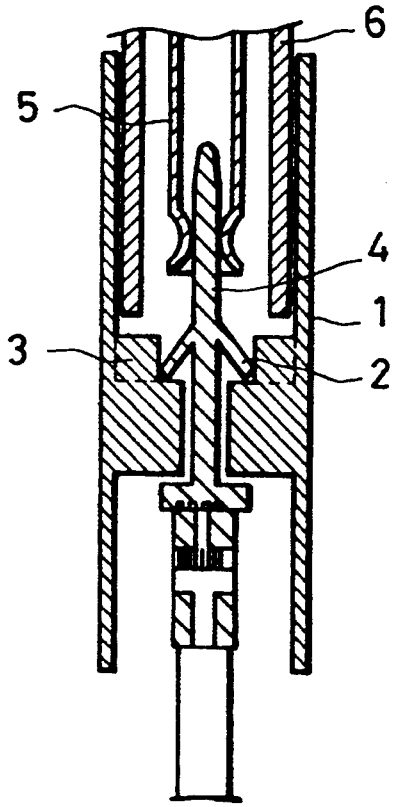
FIG. 3 is a sectional view of an electric connector showing a preferred embodiment of the present invention.
Figure 5:
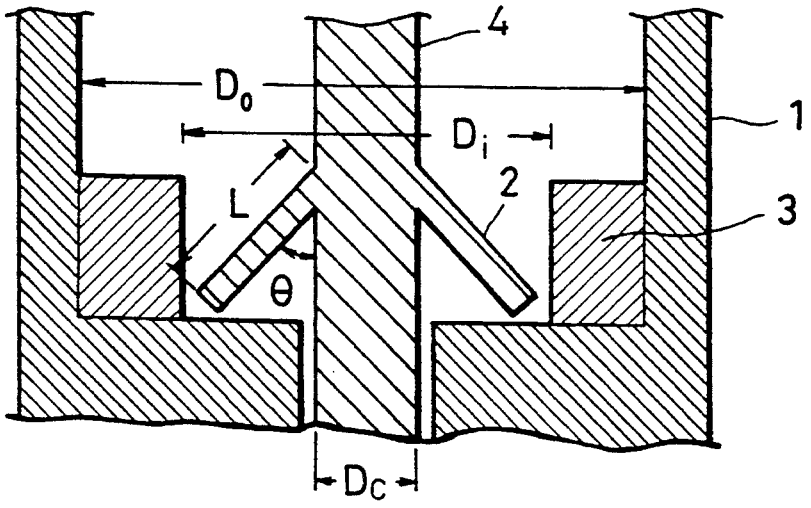
FIG. 5 is a partial enlarged sectional view of another embodiment of the present invention.

FIG. 3 shows a partial view of the outer housing of a preferred embodiment of the present invention. As in a conventional electric connector, the electric connector includes an outer housing 1 having a male contact 4 and an inner housing 6 having a female contact 5. The Male contact 4 is inserted in the outer housing 1 and has a plurality of lances 2 extending laterally and expansible to a fixed angle due to the resiliency of the lances. The electric connector of the present invention is characterized in that a tubular portion 3 serving as expansion limiting means for limiting the expansion angle $\theta$ of the lance 2 to within a predetermined angular range is additionally provided in the outer housing 1 as shown in FIG. 3. The tubular portion 3 in FIG. 3 is formed by integral molding with the outer housing 1 in such a manner as to project radially inwardly from the surface of the inner spacing of the outer housing 1. Alternatively, as shown in FIG. 5, the tubular portion 3 may be formed from the same material as the outer housing 1 and adhered to the outer housing 1 before the male contact 4 is inserted into the outer housing 1. This makes it possible to apply the present invention to conventional electric connectors already manufactured.

Figure 4:
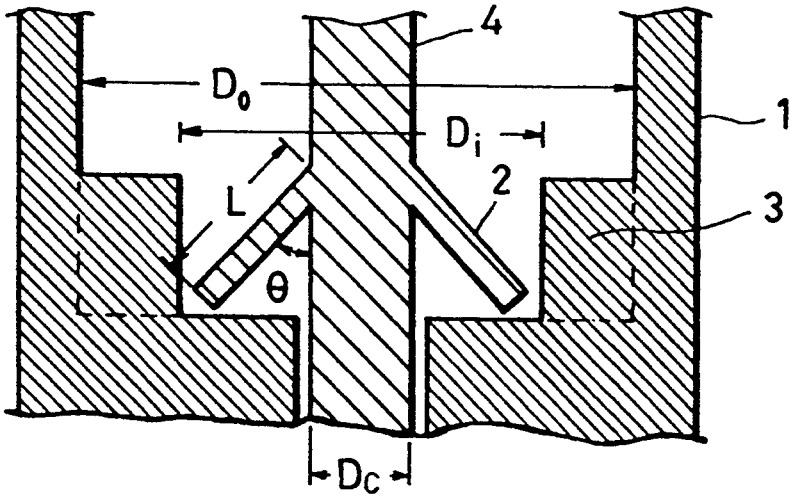
FIG. 4 is a partial enlarged sectional view of the electric connector of FIG. 3.

Referring to FIG. 4, the inner diameter Di of the tubular portion 3 is equal to the dimension of the sum of the outer diameter Dc of the male contact 4 and a distance smaller than twice the length L of the lance 2, and preferably a distance substantially equal to 1.4 L. With this construction, even if the lances 2 lose their resiliency and are forced to expand beyond the predetermined angle, the ends of the lances will be stopped by the inner wall and the bottom surface of the tubular portion 3 so that the lances 2 will be prevented from expanding to an angle perpendicular to the axis of the male contact 4. The length of 1.4 L mentioned above signifies the length of 0.7 L for each lance 2 and also signifies that the value of $\theta$ defines an angle less than 45°, and accordingly, the force acting upon each lance 2 upon the axial movement of the male contact 4 has a component of force acting in the expanding direction, that is, in a radial direction from the axis of the male contact 4 which is smaller than the other component of force acting in the axial direction.

Above description is made concerning the male contact only but is of course applicable to the female contact having lances.

It is to be understood that variations and modifications of the electric connector disclosed herein will be evident to those skilled in the art. It is intended that all such modifications and variations be included within the scope of the appended claims.

What is claimed is:

1. An electrical connector comprising an outer housing having a male contact being fixed in it, and an inner housing removably coupled to said outer housing and having a female contact which is contacted with said male contact when said male contact is inserted into said female contact for the purpose of establishing an electrical connection, wherein:

at least one contact of said male and female contacts has, as a means of fixing said contact to a corresponding housing, a plurality of lances provided thereon that expand laterally due to the resiliency thereof, each housing corresponding to the contact having said lances has a supporting means for said lances and an expansion limiting means provided on said supporting means for limiting the expansion of said lances, and said expansion limiting means comprises a tubular portion provided at the bottom of said housing through which said contact extends having an inner diameter equal to the sum of the diameter of said contact and a dimension of about 1.4 times the length of said lances, and an outer diameter sufficient for said expansion limiting means to reach the wall of the inner spacing of said housing.

2. An electrical connector as claimed in claim 1, wherein said tubular portion is a tubular member formed separately from said housing and is securely mounted in said housing upon insertion of said contact into said housing.

* * * * *